United States Patent [19]

Lundin

[11] 4,133,053

[45] Jan. 9, 1979

[54] EAR-PADS AND ASSEMBLY PROCEDURE

[75] Inventor: Tord R. Lundin, Billesholm, Sweden

[73] Assignee: Gullifiber AB, Sweden

[21] Appl. No.: 837,084

[22] Filed: Sep. 28, 1977

[30] Foreign Application Priority Data

Sep. 30, 1976 [SE] Sweden ..... 7610882

[51] Int. Cl.[2] ..... A41D 21/00

[52] U.S. Cl. ..... 2/209; 179/156 R

[58] Field of Search ..... 2/209, 423, 6; 179/156 R, 182 R

[56] References Cited

U.S. PATENT DOCUMENTS

| | | | |
|---|---|---|---|
| 3,833,939 | 9/1974 | Dostourian | 2/209 |
| 3,845,505 | 11/1974 | Davison et al. | 2/209 |
| 3,908,200 | 9/1975 | Lundin | 2/209 |

*Primary Examiner*—Peter Nerbun

*Attorney, Agent, or Firm*—Shlesinger, Fitzsimmons & Shlesinger

[57] ABSTRACT

The casings for two ear-pads are adjustably mounted on opposite ends of an arcuate headband by means of a pair of rivet-like elements, each of which extends through an elongate slot in one end of the headband, and a central opening in the associated ear-pad casing. Each rivet-like element has an enlarged-diameter cylindrical head on its inner end and an enlarged, rectangular head on its outer end which is slidable in a correspondingly shaped recess in the headband to allow adjustment of each casing in the longitudinal direction of its associated slot. A plurality of flexible, washer-like supporting members are pressed over the inner end of each element resiliently to engage opposite sides of a casing around its central opening frictionally to resist movement of each casing relative to the headband.

5 Claims, 3 Drawing Figures

EAR-PADS AND ASSEMBLY PROCEDURE

The present invention relates to a method of assembling a casing for ear-pads to be mounted on one end of a headband provided with slots or holes, and making use of an element similar to a rivet. The invention also relates to ear-pads assembled in accordance with this new method.

A known method of assembling an ear-pad casing on one end of a slotted headband makes use of an element similar to a rivet, having one end widened for gripping and the other provided with a recess adapted for the reception of a screw. In this case assembly proceeds first by passing the rivet through the appropriate slot, after which one or more compressible pierced rubber discs are passed over the rivet and positioned against the inside of the headband. The casing is then fitted over the rivet and one or more additional discs are passed over the shank of the rivet and placed so that they lie against the inside of the casing. A metal washer, pierced with a hole in its center, is then passed over the shank of the rivet and brought up against the outer disc, after which the afore-mentioned screw is introduced into the recess in the rivet and tightened until the underside of the screw head exerts a suitable pressure on the metal washer. It is of course necessary to insure that the screw has been tightened so as to allow the vertical adjustment of the casing parallel with the slot by overcoming the friction between the headband and the assembled components of the casing lying against it through manual pressure on that part of the apparatus intended for adjustment of the whole.

As will be apparent from the above description, this conventional method of assembling a casing on the end of a headband is a relatively complicated process requiring several different components — a rivet provided with a recess at one end, several discs, a metal washer pierced with a hole, and a screw.

The chief objective of this invention is to provide a simpler method for assembling a casing for ear-pads on the end of a headband. This new procedure is, moreover, made possible with the use of fewer components than previously. This is rendered possible, as per the invention, through the provision of a rivet — like element having widened ends of greater diameter than the breadth of the slot, one end of this rivet, which has the form of a head, being forced through a slot provided for the purpose; through the provision of one or more supporting elements, discs for example, which through motion relative to the element are brought into position around the shank of the rivet-like element on the inside of the headband; through passing the head, by motion relative to the casing, through a hole provided in the casing; and through the positioning of one or more additional supporting elements, the diameter of whose holes is less than that of the head, between the inner wall of the casing and the underside of the head, by a motion relative to the element, so enabling the casing to be secured between the supporting elements.

With the conventional method of assembling ear-pads mentioned above, it was necessary to make a special test to discover any defects in the material. This was naturally a time-consuming operation which was unexpectedly found to be quite eliminated in the new method of assembly, since defects in the headband are immediately discernible when the head of the rivet-like element is pressed through the appropriate slot in the headband. The headband, which is normally manufactured of plastic reinforced with glass fibre, is hereby subjected to such great stress that any defect in the material immediately causes it to break.

A suggested version of this invention is described in greater detail below by reference to the accompanying drawings, in which the holes in the headband take the form of oblong slots.

In the drawings

Figure 1:
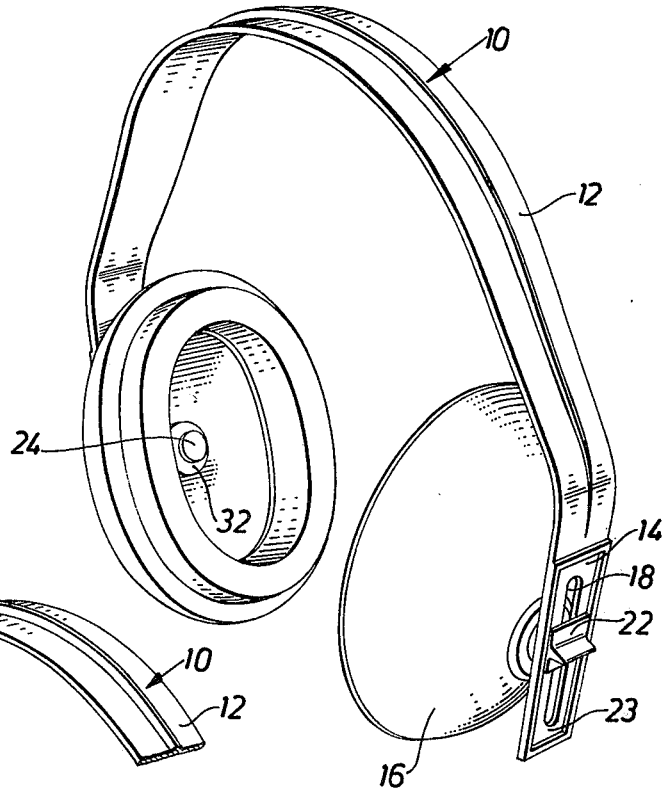
FIG. 1 shows a perspective view of ear-pads assembled according to the new method with the sound damping lining removed in order to render more visible the assembled details of the casing.

The headband 12 of the ear-pad 10 shown in FIG. 1 should preferably be of plastic reinforced with glass fibre, and is shown here with its end pieces 14 spaced slightly apart in order to render visible the individual components necessary for assembly on both the inside and outside of the casing 16, which itself is conventional.

The headband 12 is provided at each end with a closed slot 18 running for part of the length of the end pieces. Each casing 16 to be mounted on the headband is secured to the appropriate end of the headband by means of an element 20 similar to a rivet which has widened ends 22 and 24 of greater breadth than the breadth of the slot 18, and which passes intermediate its ends through a hole 25 pierced in the center of the casing. The outer end 22 of element 20 is in the form of a rectangular grip movable along the length of the slot 18 to allow adjustment of the position of the casing. The casing 16 is held securely around the element 20 by means of compressible washers or supporting members or elements 26, 28, 30, 32, each pierced with a hole, and positioned so that the inner supporting element 32 lies against the underside of the inward-facing end 24 of the rivet-like element 20, this end taking the form of a bulbous head, while the outer supporting element 26 lies against the inside of the headband 12.

The headband 12 is thus securely held between the inside of the outward-facing grip 22 of the rivet-like element 20, this grip being positioned to slide in a rectangular recess or depression 23 provided for this purpose in each end-piece 14, and the supporting elements 26, 28, 30, on the inside, there being three of these in the example here illustrated. If the individual components are suitably designed, the casing 16 can be secured to the headband 12 as tightly as may be desired, allowing the casing 16 to be moved parallel to the slot 18 and adjusted to the desired position by overcoming the friction between the headband 12 and the assembled components of the casing pressing against it. In order to prevent the supporting element 32, which is forced against the underside of the inner head 24 of the rivet-like element, from being pressed out over the head 24, and so perhaps risking that the casing 16 be moved from the position into which it was locked, it has been found of advantage to provide the lower part of the head 24 with an appreciably abrupt or straight circumferential edge 34. In this manner the head 24 is prevented from eating its was so easily into the material of the supporting element 32 against which it is pressing.

That part of the inside of the headband 12 which lies against an equivalent supporting element 26 is, in the conventional manner, provided with slightly knurled or raised sections 36 for the purpose of increasing the friction between the headband 12 and the supporting element 26, so that the chosen position of the casing 16 relative to the headband cannot too easily be unintentionally altered.

Figure 2:
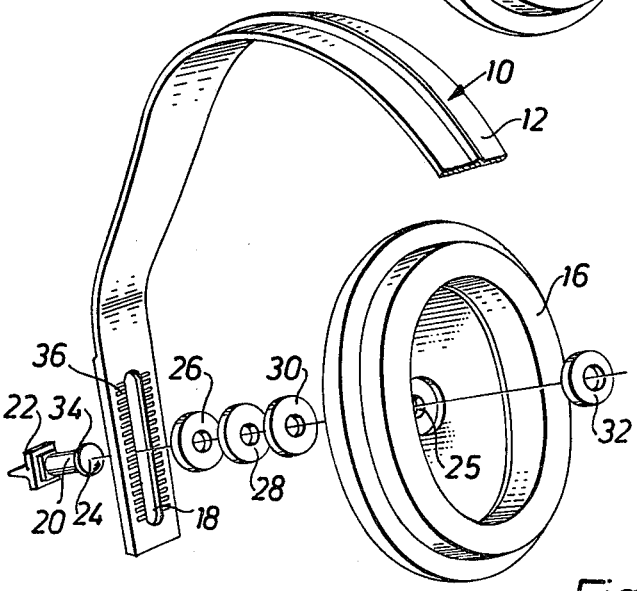
FIG. 2 shows an exploded view of part of a headband, a casing for ear-pads, and the various components required for assembling the casing on the end of the headband.
Figure 3:
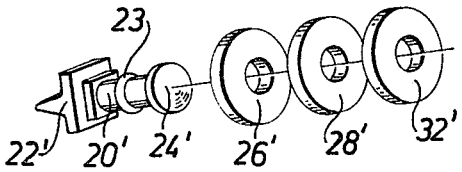
FIG. 3 shows both a perspective and an exploded view of some of the components shown in FIG. 2 in a slightly modified version.

The modified version illustrated in FIG. 3 comprises a rivet-like element 20' which differs from the equivalent element 20 shown in FIG. 2 only in that it is provided intermediate its ends with a circumferential collar 23 in approximately the middle of the space available between the two ends 22', 24' of the element. If this version is used, the headband 12 is to be held in position between the end 22' of the element and the collar 23 just mentioned, if necessary using one or more washers 26' positioned between them on either side or on both sides of the headband. The casing 16 is then secured between the collar 23 and the end 24' of the element — if necessary using one or more washers 26', 28', 32' positioned on either side or on both sides of the casing. This version is to be so designed that the casing is easily adjustable around the element 20' and can be turned without difficulty. In this manner great flexibility is achieved and the stress to which the element 20' is subjected is less than in the design shown in FIG. 2.

The total number of supporting elements is not critical but can be individually chosen so as always to be suited to the design proposed.

Having thus described my invention, what I claim is:

1. A method of assembling a casing for ear-pads on one end of a flexible headband provided with slots, and making use of an element similar to a rivet, comprising providing a rivet-like element having widened ends of greater diameter than the breadth of the slot in said headband, and forcing one end of this element which is in the form of a head, successively through said slot in the headband by motion of the element relative to the headband, through the bores in one or more washer-like supporting elements, so that the elements are brought into position around the shaft of the rivet-like element on the inside of the headband, through a hole provided in the casing, and through one or more additional washer-like supporting elements, the diameter of whose holes is less than that of the head, and which are positioned between the inner wall of the casing and the underside of the head, thereby enabling the casing to be secured between the first-named and said additional supporting elements.

2. Ear-pads, comprising a flexible headband having a pair of elongate slots in opposite ends, respectively, thereof, two casings, a pair of rivet-like elements extending through said slots and central openings in said casings, each of said elements having integral inner and outer ends, respectively, which are wider than said slots, and at least one of which ends of each element can be forced through the associated slot in said headband by snap-action while said headband is elastically distorted, and a plurality of washer-like supporting members rotatably supporting the casings on said elements at the inside surfaces of said headband, said headband being attached firmly around said elements between the outer ends thereof and said supporting members that are positioned between the headband and said casings.

3. Ear-pads as described in claim 2, wherein said supporting members are compressible, and are made preferably of rubber or plastic, and the inner end of each of said elements is in the form of a bulbous head, the lower part of which is provided with an appreciably straight edge.

4. Ear-pads as described in claim 2, wherein said outer end of each of said elements is in the form of a grip which can be guided along the appropriate slot in said headband for vertical adjustment of the associated casing.

5. Ear-pads as described in claim 2, wherein a circumferential collar is formed on each element between its widened ends.

* * * * *